US010926302B2

(12) United States Patent
Gao

(10) Patent No.: US 10,926,302 B2
(45) Date of Patent: Feb. 23, 2021

(54) AIR BLOWING DEVICE, SELF-SUCTION TAIL PLUG, AND AIR BLOWER USING THE TAIL PLUG

(71) Applicant: SHANGHAI JIEYONG TECHNOLOGY CO., LTD., Shanghai (CN)

(72) Inventor: Jiemei Gao, Shanghai (CN)

(73) Assignee: SHANGHAI JIEYONG TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/962,847

(22) PCT Filed: Nov. 6, 2018

(86) PCT No.: PCT/CN2018/114058

§ 371 (c)(1),
(2) Date: Jul. 17, 2020

(87) PCT Pub. No.: WO2019/140981

PCT Pub. Date: Jul. 25, 2019

(65) Prior Publication Data

US 2020/0406314 A1 Dec. 31, 2020

(30) Foreign Application Priority Data

Jan. 18, 2018 (CN) ..... 201810050589.4
Sep. 20, 2018 (CN) ..... 201821544843.8

(51) Int. Cl.
*B08B 5/02* (2006.01)
*B08B 13/00* (2006.01)

(52) U.S. Cl.
CPC ..... *B08B 5/02* (2013.01); *B08B 13/00* (2013.01)

(58) Field of Classification Search
CPC ..... B08B 5/02; B08B 13/00
See application file for complete search history.

(56) References Cited

U.S. PATENT DOCUMENTS 1,576,128 A * 3/1926 Ballard ..... A61C 17/022 604/26
2,674,247 A * 4/1954 Mclellan ..... A61C 17/022 604/26

(Continued)

FOREIGN PATENT DOCUMENTS

CN 201209530 Y 3/2009
CN 201253619 Y 6/2009

(Continued)

*Primary Examiner* — Dung Van Nguyen
(74) *Attorney, Agent, or Firm* — Bayramoglu Law Offices LLC

(57) ABSTRACT

An air blowing device, a self-suction tail plug, and an air blower using the tail plug are provided. The air blower includes: a manner of air inlet and outlet one-way valve, an airbag, an integrated air inlet and outlet device, and a vent valve device. One end of the airbag is provided with an opening, and the bottom end of the integrated air inlet and outlet device is provided with a connecting end. The integrated air inlet and outlet device includes an air inlet structure and an air outlet structure. A ventilation pipeline of the air inlet structure and a ventilation pipeline of the air outlet structure are ventilated into the air bag. The self-suction tail plug includes a tail plug body. The bottom of the tail plug body is provided with a suction cup capable of suctioning and fixing the air blower on the surface of an object.

19 Claims, 6 Drawing Sheets

(56) References Cited

U.S. PATENT DOCUMENTS

| | | | | |
|---|---|---|---|---|
| 3,710,413 | A * | 1/1973 | French | A46B 11/002 15/405 |
| 5,165,393 | A | 11/1992 | Kawaguchi | |
| 6,725,568 | B2 * | 4/2004 | Gronka | A61F 11/006 34/104 |
| 2011/0068197 | A1 | 3/2011 | Shen | |
| 2011/0197930 | A1 * | 8/2011 | Rahbar-Dehghan | G03B 17/56 134/34 |

FOREIGN PATENT DOCUMENTS

| | | | |
|---|---|---|---|
| CN | 201353569 | Y | 12/2009 |
| CN | 206083286 | U | 4/2017 |
| CN | 108097660 | A | 6/2018 |
| CN | 208213815 | U | 12/2018 |

* cited by examiner

AIR BLOWING DEVICE, SELF-SUCTION TAIL PLUG, AND AIR BLOWER USING THE TAIL PLUG

CROSS REFERENCE TO THE RELATED APPLICATIONS

This application is the national phase entry of International Application No. PCT/CN2018/114058, filed on Nov. 6, 2018, which is based upon and claims priority to Chinese Patent Application No. 201810050589.4, filed on Jan. 18, 2018, and No. 201821544843.8, filed on Sep. 20, 2018, the entire contents of which are incorporated herein by reference.

TECHNICAL FIELD

The present application relates to the field of cleaning appliances, and more particularly, to an air blowing device. In addition, the present application further relates to a self-suction tail plug, and an air blower using the tail plug.

BACKGROUND

The air blower is used as an air blowing type cleaning tool in the cleaning of many precision instruments that are not easy to wipe with water or cloth, such as the cleaning of digital camera lenses and computer chips.

The air blower product usually consists of three parts: a soft rubber sphere body, an air inlet, and an air outlet nozzle. When operating the air blower, first squeeze the soft rubber sphere to spray air, so as to eject the dust inside the air blower, and then aim at the dust points on the camera to spray the air to clean it. Since the air outlet nozzle of the air blower product currently on the market does not have a one-way valve structure, the air will be sucked in again by the air outlet nozzle after being sprayed out from the air outlet nozzle, the dust inside the air blower cannot be completely ejected, which weakens the cleaning effect. An inlet valve of the air blower is usually at the tail, the filtering effect is very small; some products have an additional structure at the tail to increase area of the filter paper, but it affects the operation and also greatly affects the appearance.

In addition, when using the conventional air blower, the airbag is squeezed to make the air in the airbag spray out from the air nozzle to blow off the dust on the surface to be cleaned. However, the conventional air blower is typically light in weight, it has a wide body and a narrow tail, it is very easy to tilt and fall when being placed on a desktop, and it can roll down everywhere, which causes great trouble in placement and use.

SUMMARY

The main objective of the present application is to provide an air blowing device, so as to solve the problems described above.

In addition, the present application further provides a self-suction tail plug and an air blower using the tail plug, so as to solve the problems that the air blower is easy to tilt and has poor stability.

To achieve the above objective, according to an aspect of the present application, there is provided an air blowing device, comprising: an airbag, an integrated air inlet and outlet device, and a vent valve device; one end of the airbag is provided with one opening, a bottom end of the integrated air inlet and outlet device is further provided with a connecting end adapted to the opening, the connecting end is for fixing the integrated air inlet and outlet device on the airbag; the integrated air inlet and outlet device includes an air inlet structure and an air outlet structure that are mutually fixed; ventilation pipelines of the air inlet structure and the air outlet structure are independent of each other, and ventilation pipelines of the air inlet structure and the air outlet structure are connected to the airbag respectively; the vent valve device includes an air inlet one-way valve and an air outlet one-way valve; the air inlet one-way valve is adaptively disposed at a position where the air inlet structure is ventilated into the airbag, and is used for introducing external air into the airbag unidirectionally; the air outlet one-way valve is adaptively disposed at a position where the air outlet structure is ventilated into the airbag, and is used for discharging air in the airbag from an air outlet nozzle unidirectionally.

Further, in the air blowing device as described above, a bottom end of the air inlet structure is ventilated into the airbag, the air inlet structure is set as hollow, and several strip-shaped air inlets are disposed on a surface of the air inlet structure, so that it enables outside air to enter the airbag from the air inlets.

Further, in the air blowing device as described above, the air outlet structure is a long-tubular-shaped ventilation pipeline, a bottom end of the air outlet structure is ventilated into the airbag, and a top end of the air outlet structure is an air outlet nozzle, so that air in the airbag can be blown out from the air outlet nozzle.

Further, in the air blowing device as described above, the air inlet structure is ring-shaped and disposed around the air outlet structure.

Further, in the air blowing device as described above, the connecting end is provided with a cavity adapting to a shape of the vent valve device, the cavity is for placing the vent valve device.

Further, in the air blowing device as described above, the connecting end is a hollow winding shaft shape, and an outer surface of the connecting end is recessed in the middle for being securely sleeved with the opening of the airbag.

Further, the air blowing device as described further comprises: an annular filter paper; the filter paper is disposed between a bottom of the air inlet structure and the connecting end.

Further, in the air blowing device as described above, a bottom of the airbag is a horizontal plane.

Further, in the air blowing device as described above, the integrated air inlet and outlet device is arranged in a contraction shape from bottom to top.

Further, in the air blowing device as described above, the airbag is made of silicone or rubber material.

According to another aspect of the present application, there is provided a self-suction tail plug.

The self-suction tail plug according to the present application comprises: a detachable tail plug body disposed at a bottom of an air blower; a suction cup capable of adsorbing and fixing the air blower on a surface of an object is disposed at a bottom of the tail plug body, an outer wall of a top of the tail plug body is provided with a fixed protrusion ring that is engaged with the bottom of the air blower, the suction cup and the air blower are hermetically connected.

Further, a sealing protrusion ring is disposed on an outer wall of the tail plug body along a circumferential direction, and the sealing protrusion ring is hermetically connected with the bottom of the air blower.

Further, the tail plug body is provided with an air inlet penetrating from top to bottom, a one-way valve body is disposed on the top of the tail plug body, an air outlet is disposed between the one-way valve body and the tail plug body, the air outlet is connected with the air inlet; when the air blower is inhaling, the air outlet is opened under the action of external air pressure, air enters the air blower through the air outlet; when the air blower is spraying, the air outlet is closed under the action of air pressure inside the air blower.

Further, a connector is disposed at an edge of the one-way valve body, the one-way valve body is connected to the tail plug body through the connector.

Further, the air outlet is a slit-shaped opening opened between the tail plug body and the one-way valve body.

Further, the one-way valve body, the connector, and the tail plug body are integrally formed.

Further, the tail plug body has a cylindrical structure.

Further, the suction cup is an inverted bowl-shaped structure.

Further, the tail plug body is made of silicone or rubber.

To achieve the above objective, according to another aspect of the present application, there is provided an air blower.

The air blower according to the present application comprises an air blower body and a self-suction tail plug as described above, a tail plug socket connected with an internal airbag is disposed at a bottom of the air blower body, the suction tail plug is connected with the tail plug socket adaptively.

The beneficial effects of the present application are:

The present application adopts the manner of setting the air inlet and outlet one-way value through an airbag, an integrated air inlet and outlet device, and a vent valve device; one end of the airbag is provided with one opening, a bottom end of the integrated air inlet and outlet device is further provided with a connecting end adapted to the opening, the connecting end is for fixing the integrated air inlet and outlet device on the airbag; the integrated air inlet and outlet device includes an air inlet structure and an air outlet structure that are mutually fixed; ventilation pipelines of the air inlet structure and the air outlet structure are independent of each other, and ventilation pipelines of the air inlet structure and the air outlet structure are connected to the airbag respectively; the vent valve device includes an air inlet one-way valve and an air outlet one-way valve; the air inlet one-way valve is adaptively disposed at a position where the air inlet structure is ventilated into the airbag, and is used for introducing external gas into the airbag unidirectionally; the air outlet one-way valve is adaptively disposed at a position where the air outlet structure is ventilated into the airbag, and is used for discharging gas in the airbag from an air outlet nozzle unidirectionally. Accordingly, more space is expanded for product shape and function; the risk of inlet/outlet one-way valve falling is reduced; the structure is integrated to reduce the weight of the product; the combination of the inlet value and the outlet valve can increase the area of the filter paper, which makes the air filtration efficient.

In addition, the present application adopts a manner of disposing a suction cup at the bottom of the tail plug body, the purpose of fixing the air blower firmly on the surface of the object is achieved through the suction force of the suction cup to the surface of the object, thereby avoiding easy tilting when the air blower is in a placed state, the technical problem that the air blower is easy to tilt and has poor stability is solved. In addition, the air inlet can be opened on the tail plug body according to the blowing manner of the air blower, and a one-way valve structure is disposed between the air inlet and the tail plug body to meet the air inlet demand of the air blower, good air tightness is provided while the air blower is in an air blowing state, which ensures good use of the air blower. The structure of this type of tail plug body is suitable for a variety of air blowers, which improves applicability of the present application and is suitable for large-scale promotion and use.

BRIEF DESCRIPTION OF THE DRAWINGS

The drawings that constitute a part of the present application are used to provide a further understanding of the present application, so that other features, objectives, and advantages of the present application become more apparent. The drawings and descriptions of the exemplary embodiments of the present application are intended to explain the present application, rather than constituting improper limitation on the present application. In the drawings.

DETAILED DESCRIPTION OF THE EMBODIMENTS

Hereinafter, the technical solutions in the embodiments of the present disclosure will be described in a clear and complete way with reference to the accompanying drawings, so as to facilitate a person skilled in the art better understanding the solutions of the present application. Obviously, these described embodiments are merely parts of the embodiments of the present disclosure, rather than all of the embodiments thereof. Other embodiments obtained by a person of ordinary skill in the art based on the embodiments of the present disclosure without paying creative effort all fall into the protection scope of the present disclosure.

It should be noted that, in the case of no conflict, the embodiments of the present invention and the features thereof may be combined. The present application will be described in detail below with reference to the drawings and in conjunction with the embodiments.

Figure 1:
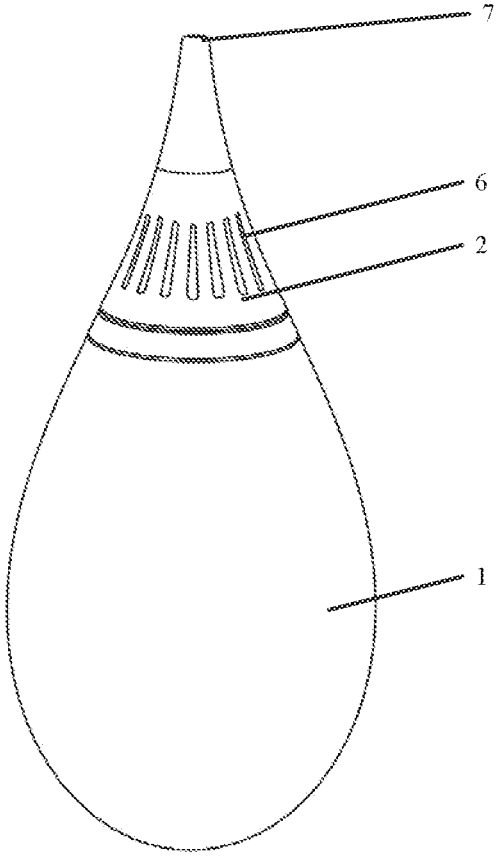
FIG. 1 is a front view of the device structure in an embodiment of the present application.
Figure 2:
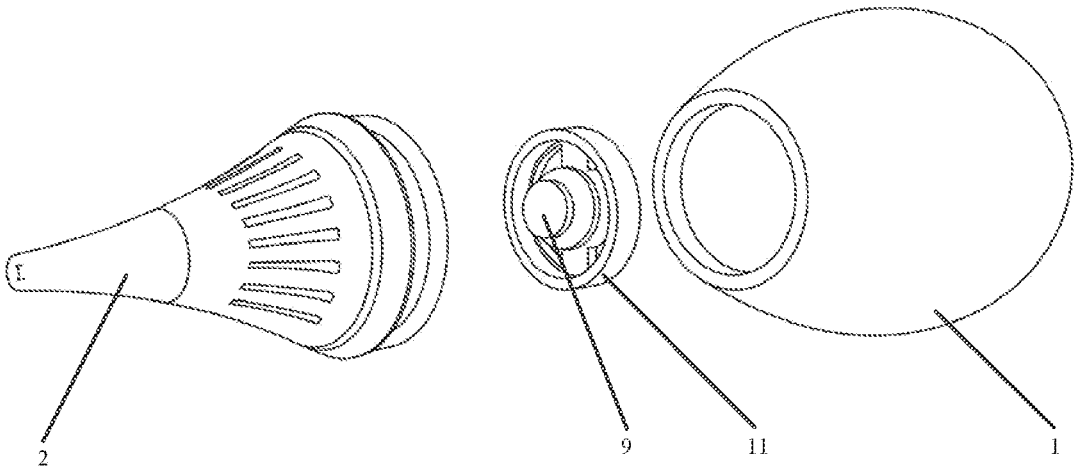
FIG. 2 is an exploded view of the device structure in an embodiment of the present application.
Figure 3:
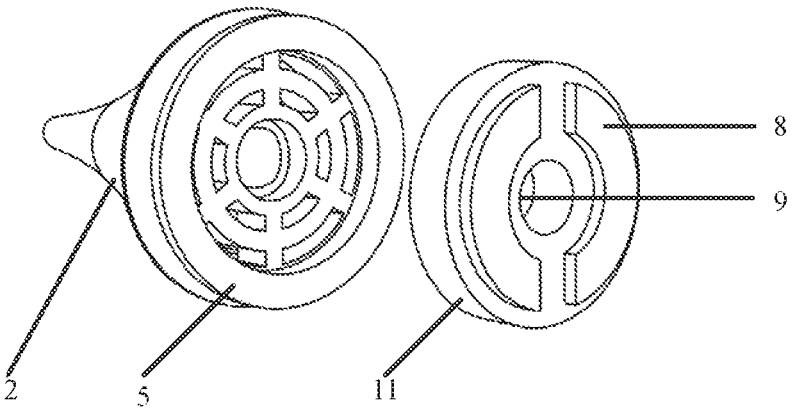
FIG. 3 is a schematic structural view of an integrated air inlet and outlet device and a vent valve device in an embodiment of the present application.

As shown in FIGS. 1, 2 and 3, the present application provides an air blowing device, comprising: an airbag 1, an integrated air inlet and outlet device 2, and a vent valve device 11; one end of the airbag 1 is provided with one opening, a bottom end of the integrated air inlet and outlet device 2 is further provided with a connecting end 5 adapted to the opening, the connecting end 5 is for fixing the integrated air inlet and outlet device 2 on the airbag 1; the integrated air inlet and outlet device 2 includes an air inlet structure 3 and an air outlet structure 4 that are mutually fixed; ventilation pipelines of the air inlet structure 3 and the air outlet structure 4 are independent of each other, and ventilation pipelines of the air inlet structure 3 and the air outlet structure 4 are connected to the airbag 1 respectively; the vent valve device 11 includes an air inlet one-way valve 8 and an air outlet one-way valve 9; the air inlet one-way valve 8 is adaptively disposed at a position where the air inlet structure 3 is ventilated into the airbag 1, and is used for introducing external air into the airbag 1 unidirectionally; the air outlet one-way valve 9 is adaptively disposed at a position where the air outlet structure 4 is ventilated into the airbag 1, and is used for discharging air in the airbag 1 from an air outlet nozzle 7 unidirectionally. At the time of using the air blower with the air outlet one-way valve 9, the airbag is squeezed, the air is blown out from the air outlet structure 4, when the airbag 1 is released, the air can only be sucked into the airbag 1 from the air inlet structure 3, which can avoid the air outlet structure 4 from sucking back air so as to effectively prevent dust from being sucked in and causing secondary pollution. The air outlet one-way valve 9 is disposed so that the air outlet structure 4 only outlets air but does not inlet air, which ensures cleanliness of the air in the airbag 1. By disposing the inlet one-way valve 8, the airbag can be squeezed during use to prevent air from being blown out from the inlet one-way valve 8, when the airbag 1 is released, negative pressure sucks air into the airbag 1 from the outside through the inlet one-way valve 8. The air inlet one-way valve 8 is disposed so that the air in the air blower flows in one direction, the end for air inlet cannot outlet the air, which ensures that the air will not be blown out from the air inlet structure 3 when the airbag 1 is squeezed. Moreover, preferably, the air outlet one-way valve 9 is circular, and the air inlet one-way valve 8 is a circular ring disposed outside the air outlet one-way valve 9. Accordingly, more space is expanded for product modeling and function; the risk of the air inlet/outlet one-way falling is reduced; the structure is integrated to reduce weight of the product; the air inlet/outlet valve combination can increase the area of the filter paper and make the air filtration efficient. If the inlet one-way valve 8 and the outlet one-way valve 9 are separately fixed by dispensing, the two one-way valves have the risk of falling. In this solution, the inlet one-way 8 and the outlet one-way 9 are integrated into one piece, which increases the dispensing area, improves the firmness, and reduces the risk of falling.

In some embodiments, in the air blowing device as described above, a bottom end of the air inlet structure 3 is ventilated into the airbag 1, the air inlet structure 3 is set as hollow, and several strip-shaped air inlets 6 are disposed on a surface of the air inlet structure 3, so that it enables outside air to enter the airbag 1 from the air inlets 6. Specifically, the air inlet structure 3 refers to all device structural parts for making outside air enter the airbag 1; outside air is allowed to enter the airbag by providing a plurality of strip-shaped air inlets 6, and can cover the internal air inlet channel to prevent damage to the air inlet channel. Due to the integrated air inlet and outlet device 2 in the present application, if the damage occurs, ventilation pipelines of the air inlet structure 3 and the air output structure 4 will penetrate through each other, which affects normal use of the air path and the device.

In some embodiments, in the air blowing device as described above, the air outlet structure 4 is a long-tubular-shaped ventilation pipeline, a bottom end of the air outlet structure 4 is ventilated into the airbag 1, and a top end of the air outlet structure 4 is an air outlet nozzle 7, so that air in the airbag 1 can be blown out from the air outlet nozzle 7.

In some embodiments, the air inlet structure 3 is ring-shaped and disposed around the air outlet structure 4. Adopting the ring-shaped arrangement can make the device inlet air from all directions evenly, which improves the inlet efficiency of various parts, and enables the airbag 1 to complete an air intake step with the highest efficiency.

In some embodiments, in the air blowing device as described above, the connecting end 5 is provided with a cavity adapting to a shape of the vent valve device 11, the cavity is for placing the vent valve device 11. Preferably, the connecting end and the vent valve device 11 are integrated through an injection molding process, so that the appearance is more overall and compact, and scalability of product shape and function is increased.

In some embodiments, in the air blowing device as described above, the connecting end 5 is a hollow winding shaft shape; and an outer surface of the connecting end 5 is recessed in the middle for being securely sleeved with the opening of the airbag 1. The winding shaft shape is specifically that the middle is a round tube and protruding ring parts are disposed at two ends, so that the middle part forms a recessed part; with this arrangement, the connecting end 5 and the airbag 1 can be conveniently installed and disassembled. In general, the opening of the airbag 1 is adapted to the outer cross-section of the recessed part, so it can ensure good sealing.

Figure 4:
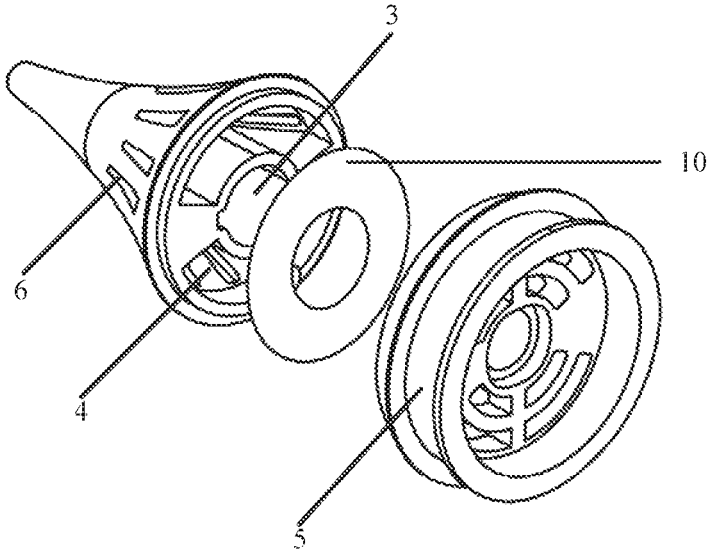
FIG. 4 is an exploded view of an integrated air inlet and outlet device in an embodiment of the present application.

As shown in FIG. 4, in some embodiments, the air blowing device as described above further comprises an annular filter paper 10; the filter paper 10 is disposed between a bottom of the air inlet structure 3 and the connecting end 5. The shape and size of the filter paper 10 match the shape of the bottom of the air inlet structure 3. Since the main function of the air blowing device is to blow away the dust on the surface of the instruments, the problem of secondary pollution will occur if the air entering the air blowing device itself contains dust. By installing the filter paper 10, the air blowing device can effectively purify the air inside to filter out the dust and other particulate matter so as to ensure cleanness of the air entering the air blowing device.

In some embodiments, in the air blowing device as described above, a bottom of the airbag 1 is a horizontal plane. Therefore, the device can have an upright function to prevent the device from rolling or the like.

In some embodiments, in the air blowing device as described above, the integrated air inlet and outlet device 2 is arranged in a contraction shape from bottom to top. In general, the overall shape is a conical shape that shrinks toward an air outlet hole of the air outlet channel. Using this shape allows the user to clearly know the location of insufflation, which is convenient to accurately point at the area where insufflation is needed. At the meantime, the insufflation part is small, various hidden or corner positions can also be easily cleaned, which improves the overall product experience.

In some embodiments, in the air blowing device as described above, the airbag 1 is made of silicone or rubber.

Both silicone and rubber materials have good elasticity and durability, and are easy to manufacture and shape into various shapes, besides, they are widely available and inexpensive, with which it is easy to reduce product manufacturing cost and promote use.

Figure 5:
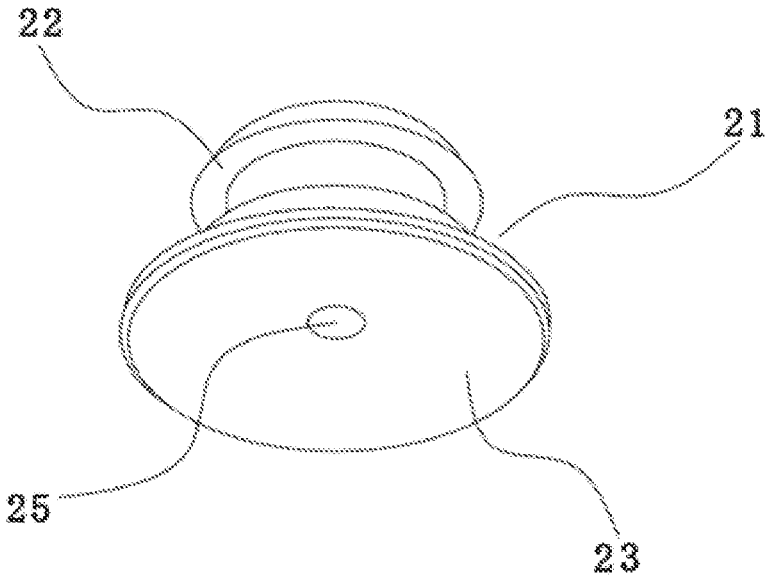
FIG. 5 is a schematic diagram of lower structure of a self-suction tail plug in another embodiment of the present application.
Figure 6:
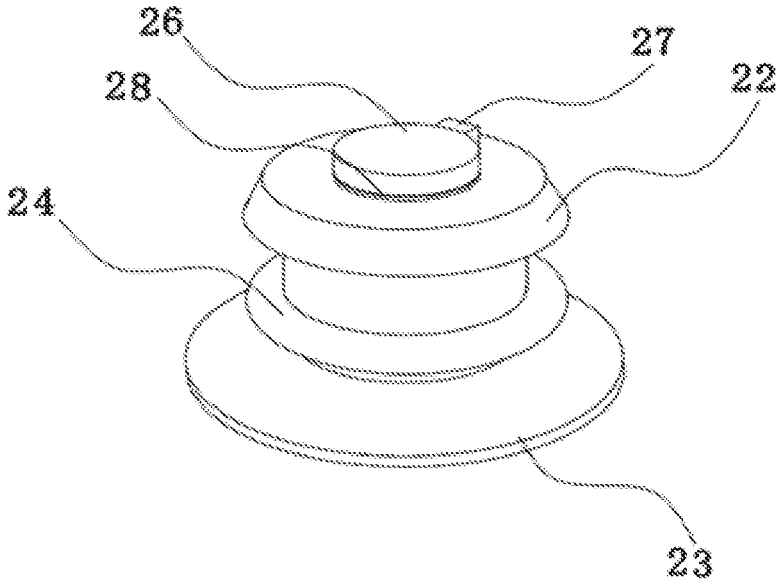
FIG. 6 is a schematic diagram of upper structure of a self-suction tail plug in another embodiment of the present application.

As shown in FIGS. 5 and 6, the present application further relates to a self-suction tail plug, the self-suction tail plug comprises a tail plug body 21 detachably disposed at a bottom of an air blower, a suction cup 23 is disposed at a bottom of the tail plug body 21, the air blower can be absorbed and fixed on a surface of an object under the suction force of the suction cup 23. An outer wall of a top of the tail plug body 21 is provided with a fixed protrusion ring 22 along a circumferential direction of the tail plug body 21, a concave part that adapts to the fixed protrusion ring 22 is disposed on the bottom of the air blower, the fixed protrusion ring 22 is engaged with the concave part, so that the tail plug body 21 is adaptively connected to the bottom of the air blower, the contact surfaces between the suction cup 23 and the air blower are hermetically connected. Adopting the manner of disposing the suction cup 23 at the bottom of the tail plug body 21, the purpose of fixing the air blower firmly on the surface of the object is achieved through the suction force of the suction cup 23 on the surface of the object, thereby the technical effect of avoiding easy tilting when the air blower is in a placed state is achieved.

As shown in FIG. 6, a sealing protrusion ring 24 is disposed on an outer wall of the tail plug body 21 along a circumferential direction, the sealing protrusion ring 24 is hermetically connected with the bottom of the air blower. The setting of the sealing protrusion ring 24 ensures a good sealing effect when the tail plug body 21 and the bottom of the air blower are connected.

Figure 7:
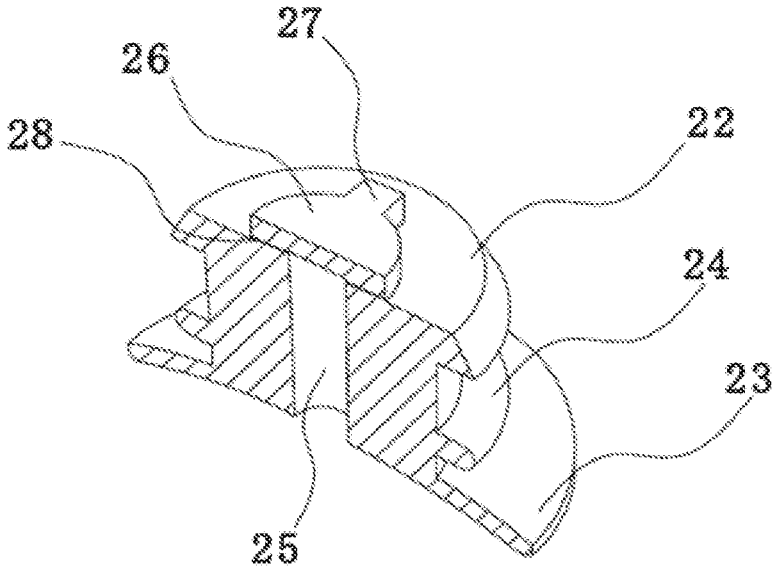
FIG. 7 is a perspective cross-sectional view of a self-suction tail plug in another embodiment of the present application.
Figure 8:
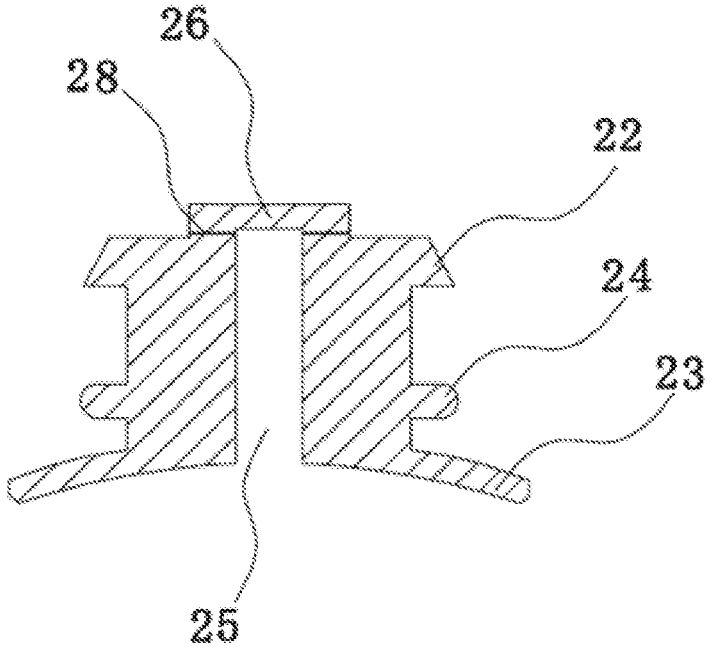
FIG. 8 is a front cross-sectional view of a self-suction tail plug in another embodiment of the present application.

As shown in FIGS. 7 and 8, the tail plug body 21 is provided with an air inlet 25 penetrating from top to bottom, a one-way valve body 26 is disposed on the top of the tail plug body 21, an air outlet 28 is disposed between the one-way valve body 26 and the tail plug body 21, the air outlet 28 is a slit-shaped opening, the air outlet 28 is connected with the air inlet 25; when the air blower is inhaling, the air outlet 28 is opened under the action of external air pressure, air enters the air blower through the air outlet 28; when the air blower is spraying, the air outlet 28 is closed under the action of air pressure inside the air blower. The air inlet 25 may be opened in the tail plug body 21 according to the blowing manner of the air blower, and a one-way structure is disposed between the air inlet 25 and the tail plug body 21 to meet the air blowing demand of the air blower, it provides good air tightness in an air blowing state of the air blower, which ensures good use effect of the air blower. The structure of the tail plug body 21 is suitable for a variety of air blower, which improves applicability of the present application and is suitable for large-scale promotion and use.

As shown in FIG. 7, a connector 27 is disposed at an edge of the one-way valve body 26, the one-way valve body 26 is connected to the tail plug body 21 through the connector 27, which enhances stability of the connection between the one-way valve body 26 and the tail plug body 21, extends the service life of the one-way valve body 26.

In some embodiments of the present application, the one-way valve body 26, the connector 27, and the tail plug body 21 are integrally formed, which facilitates manufacturing and processing, and can effectively avoid missing of various parts.

In some embodiments of the present application, the tail plug body 21 may be, but not limited to, a cylindrical structure, so long as it is ensured that the tail plug body 21 can be adaptively connected with the air blower.

In some embodiments of the present application, the suction cup 23 may be, but not limited to, an inverted bowl-shaped structure, so long as it can increase the suction force of the suction cup 23 on the surface of the object and improve stability of the air blow placed on the surface of the object.

In some embodiments of the present application, the material of the tail plug body 21 may be, but not limited to, silicone or rubber.

Figure 9:
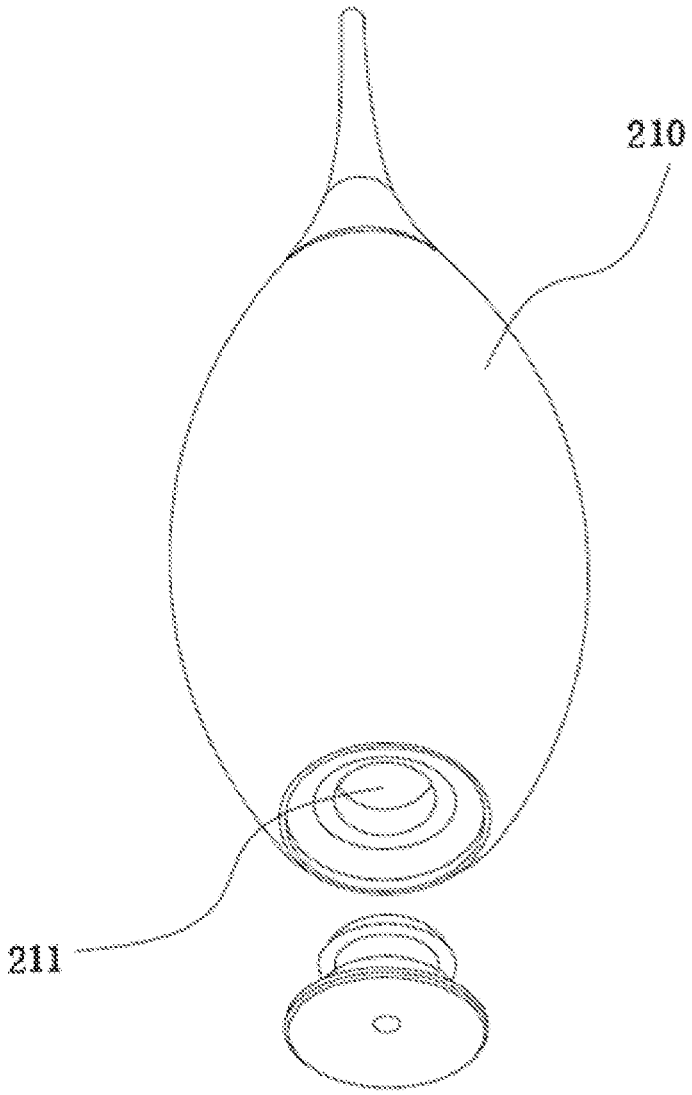
FIG. 9 is a schematic structural view of a state where the air blower is not installed with a self-suction tail plug in another embodiment of the present application.
Figure 10:
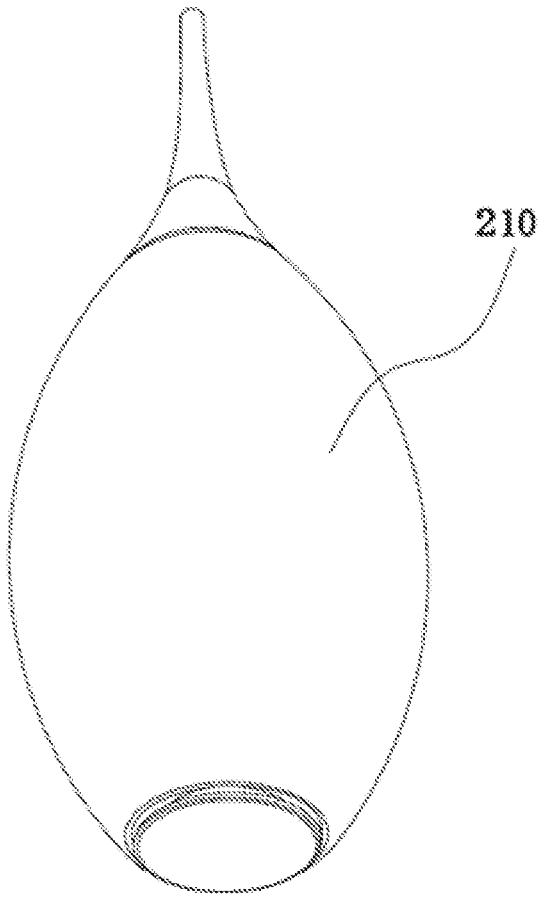
FIG. 10 is a schematic structural view of a state in which a self-suction tail plug is installed by an air blower in another embodiment of the present application.

As shown in FIGS. 9 and 10, the present application relates to an air blower comprising an air blower body 210 and the above-described self-suction tail plug. A tail plug socket 211 connected with an internal airbag is disposed at a bottom of the air blower body 210, the suction tail plug is connected with the tail plug socket 211 adaptively.

The working principle of the device is as follows: when the air blower is in a placed state, the air blower is firmly adsorbed on the surface of the object through the suction cup 23 at the bottom of the tail plug body 21, which can prevent tilting and rolling down of the air blower in the natural state. In an air blowing state, the air blowing body 210 is squeezed, the air enters the airbag of the air blowing body 210 through the air inlet 25 and the one-way valve body 26, the air is led out to the air nozzle of the air blowing body 210 unidirectionally through the one-way body 26, air is ejected through the air nozzle, and the ejected air will blow off the dust on the surface to be cleaned.

From the above description, it can be seen that the present invention achieves the following technical effects: the present application adopts a manner of disposing a suction cup 23 at the bottom of the tail plug body 21, the purpose of fixing the air blower firmly on the surface of the object is achieved through the suction force of the suction cup 23 to the surface of the object, thereby avoiding easy tilting when the air blower is in a placed state, the technical problem that the air blower is easy to tilt and has poor stability is solved. In addition, the air inlet 25 can be opened on the tail plug body 22 according to the blowing manner of the air blower, and a one-way valve structure is disposed between the air inlet 25 and the tail plug body 21 to meet the air inlet demand of the air blower, good air tightness is provided while the air blower is in an air blowing state, which ensures good use of the air blower. The structure of this type of tail plug body is suitable for a variety of air blower, which improves applicability of the present application and is suitable for large-scale promotion and use.

The above are only the preferred embodiments of the present application, not intended to limit the present application. For those skilled in the art, the present application may have various modifications and changes. Any modification, equivalent replacement, improvement or the like made within the spirit and principle of the present application shall fall into the protection scope of the present application.

INDUSTRIAL APPLICABILITY

The present application adopts the manner of setting the inlet and outlet air one-way valve, the risk of inlet/outlet one-way valve falling is reduced; the structure is integrated to reduce the weight of the product; the combination of the inlet value and the outlet valve can increase the area of the filter paper, which makes the air filtration efficient.

In addition, the present application adopts the manner of disposing a suction cup at the bottom of the tail plug body, the purpose of fixing the air blower firmly on the surface of the object is achieved through the suction force of the suction cup to the surface of the object, thereby avoiding easy tilting when the air blower is in a placed state, the technical problem that the air blower is easy to tilt and has poor stability is solved.

In addition, the air inlet can be opened on the tail plug body according to the blowing manner of the air blower, and a one-way valve structure is disposed between the air inlet and the tail plug body to meet the air inlet demand of the air blower, good air tightness is provided while the air blower is in an air blowing state, which ensures good use of the air blower. The structure of this type of tail plug body is suitable for a variety of air blower, which improves applicability of the present application and is suitable for large-scale promotion and use.

What is claimed is:

1. An air blowing device, comprising:

an airbag, an integrated air inlet and outlet device, and a vent valve device; wherein one end of the airbag is provided with an opening, a bottom end of the integrated air inlet and outlet device is provided with a connecting end matched with the opening, the connecting end is configured to fix the integrated air inlet and outlet device on the airbag;

the integrated air inlet and outlet device comprises an air inlet structure and an air outlet structure, wherein the air inlet structure and the air outlet structure are fixed to each other; a ventilation pipeline of the air inlet structure and a ventilation pipeline of the air outlet structure are independent of each other, and the ventilation pipeline of the air inlet structure and the ventilation pipeline of the air outlet structure are connected to the airbag, respectively;

the vent valve device comprises an air inlet one-way valve and an air outlet one-way valve; the air inlet one-way valve is disposed at a first position, wherein the air inlet structure is ventilated into the airbag at the first position, and the air inlet one-way valve is configured to introduce external air into the airbag unidirectionally; the air outlet one-way valve is disposed at a second position, wherein the air outlet structure is ventilated into the airbag at the second position, and the air outlet one-way valve is configured to discharge air in the airbag from an air outlet nozzle unidirectionally.

2. The air blowing device according to claim 1, wherein a bottom end of the air inlet structure is ventilated into the airbag, the air inlet structure is hollow, and at least one strip-shaped air inlet is disposed on a surface of the air inlet structure and configured to allow the external air to enter the airbag from the at least one strip-shaped air inlet.

3. The air blowing device according to claim 1, wherein the air outlet structure is a long-tubular-shaped ventilation pipeline, a bottom end of the air outlet structure is ventilated into the airbag, a top end of the air outlet structure is the air outlet nozzle, and the air in the airbag is blown out from the air outlet nozzle.

4. The air blowing device according to claim 1, wherein the air inlet structure is ring-shaped and disposed around the air outlet structure.

5. The air blowing device according to claim 4, wherein the connecting end is provided with a cavity corresponding to a shape of the vent valve device, and the cavity is configured to place the vent valve device.

6. The air blowing device according to claim 1, wherein the connecting end is a hollow shaft, an outer surface of the connecting end is concave, and the connecting end is connected to the opening of the airbag.

7. The air blowing device according to claim 1, further comprising: an annular filter paper; wherein the annular filter paper is disposed between a bottom of the air inlet structure and the connecting end.

8. The air blowing device according to claim 1, wherein a bottom of the airbag is a horizontal plane.

9. The air blowing device according to claim 1, wherein the integrated air inlet and outlet device is conical from bottom to top.

10. The air blowing device according to claim 1, wherein the airbag is made of silicone or rubber.

11. A self-suction tail plug, comprising:

a detachable tail plug body; wherein the detachable tail plug body is disposed at a bottom of an air blower; a suction cup is disposed at a bottom of the detachable tail plug body and is configured to adsorb and fix the air blower on a surface of an object, an outer wall at a top of the detachable tail plug body is provided with a fixed protrusion ring engaged with the bottom of the air blower, and the suction cup and the air blower are hermetically connected;

wherein a sealing protrusion ring is disposed on the outer wall of the detachable tail plug body along a circumferential direction, and the sealing protrusion ring is hermetically connected to the bottom of the air blower.

12. The self-suction tail plug according to claim 11, wherein the detachable tail plug body is provided with an air inlet penetrating from top to bottom, a one-way valve body is disposed on the top of the detachable tail plug body, an air outlet is disposed between the one-way valve body and the detachable tail plug body, the air outlet is connected to the air inlet; and when the air blower is inhaling, the air outlet is opened under an action of an external air pressure, air enters the air blower through the air outlet; and when the air blower is spraying, the air outlet is closed under an action of an air pressure inside the air blower.

13. The self-suction tail plug according to claim 12, wherein a connector is disposed at an edge of the one-way valve body, and the one-way valve body is connected to the detachable tail plug body through the connector.

14. The self-suction tail plug according to claim 13, wherein the air outlet is a slit-shaped opening formed between the detachable tail plug body and the one-way valve body.

15. The self-suction tail plug according to claim 13, wherein the one-way valve body, the connector, and the detachable tail plug body are formed into one piece.

16. The self-suction tail plug according to claim 11, wherein the detachable tail plug body has a cylindrical structure.

17. The self-suction tail plug according to claim 11, wherein the suction cup is an inverted bowl-shaped structure.

18. The self-suction tail plug according to claim 11, wherein the detachable tail plug body is made of silicone or rubber.

19. An air blower, comprising: an air blower body and the self-suction tail plug according to claim 11, a tail plug socket connected to an internal airbag is disposed at a bottom of the air blower body, and the self-suction tail plug is connected to and matched with the tail plug socket.

* * * * *